US011083211B2

(12) United States Patent
Greenbaum et al.

(10) Patent No.: US 11,083,211 B2
(45) Date of Patent: Aug. 10, 2021

(54) CANNABIS BASED MOIST SNUFF

(71) Applicant: RESURGENT PHARMACEUTICALS, INC., Minneapolis, MN (US)

(72) Inventors: Eric Greenbaum, New York, NY (US); Kyle Kingsley, Minneapolis, MN (US)

(73) Assignee: RESURGENT PHARMACEUTICALS, INC., Minneapolis, MN (US)

( * ) Notice: Subject to any disclaimer, the term of this patent is extended or adjusted under 35 U.S.C. 154(b) by 0 days.

(21) Appl. No.: 15/484,081

(22) Filed: Apr. 10, 2017

(65) Prior Publication Data

US 2019/0037909 A1 Feb. 7, 2019

Related U.S. Application Data

(60) Provisional application No. 62/320,563, filed on Apr. 10, 2016.

(51) Int. Cl.

| | |
|---|---|
| ***A24B 15/16*** | (2020.01) |
| ***A24B 15/30*** | (2006.01) |
| ***A24B 15/28*** | (2006.01) |
| ***A24B 13/00*** | (2006.01) |

(52) U.S. Cl.
CPC ..... *A24B 15/16* (2013.01); *A24B 13/00* (2013.01); *A24B 15/282* (2013.01); *A24B 15/303* (2013.01)

(58) Field of Classification Search
None
See application file for complete search history.

(56) References Cited

U.S. PATENT DOCUMENTS

| | | | | |
|---|---|---|---|---|
| 9,044,390 | B1 * | 6/2015 | Speier | A61K 36/00 |
| 9,913,868 | B1 * | 3/2018 | Alfiere | A61K 36/185 |
| 2004/0123873 | A1 * | 7/2004 | Calandro | A24B 15/16 131/359 |
| 2011/0139166 | A1 * | 6/2011 | Luzenberg, Jr. | A24B 13/00 131/359 |
| 2015/0096189 | A1 * | 4/2015 | Hawes | F26B 21/08 34/474 |
| 2016/0199299 | A1 * | 7/2016 | Uren | A61K 9/0056 131/352 |

OTHER PUBLICATIONS

"Sammy's Fan Leaf Processing Guide for Great Edibles", PsychedelicSam, Jun. 2, 2013, <https://www.rollitup.org/t/sammys-fan-leaf-processing-guide-for-great-edibles.663460/> (Year: 2013).*
"Can Cannabis Leaves be Smoked?", LaMota, Aug. 18, 2015, <https://www.lamota.org/en/blog/can-cannabis-leaves-be-smoked/> (Year: 2015).*

* cited by examiner

*Primary Examiner* — Michael H. Wilson
*Assistant Examiner* — Katherine A Will
(74) *Attorney, Agent, or Firm* — Billion & Armitage

(57) ABSTRACT

A non tobacco, cannabis based moist snuff composition is provided. The composition includes an herbal component primarily made up of cannabis leaves and/or stems and a casing component. Methods for producing a nontobacco cannabis based moist snuff composition are also provided. The method includes the steps of separating the leaves and stems from the cannabis plant, drying and curing them and mixing them with a casing component.

20 Claims, No Drawings

CANNABIS BASED MOIST SNUFF

STATEMENT REGARDING FEDERALLY SPONSORED RESEARCH

N/A

FIELD OF THE INVENTION

The present invention relates generally to cannabis based moist snuff compositions.

BACKGROUND OF THE INVENTION

Smokeless tobacco products are a multi billion dollar worldwide industry, with moist snuff being the most popular. Despite their popularity smokeless tobacco is associated with a variety of health risks, most notably mouth and GI cancers.

Cannabis consumption, particularly in states that allow recreational use is a rapidly growing market and consumers are eager to try new cannabis based products.

As such there is a market opportunity for a cannabis based moist snuff tobacco alternative.

SUMMARY OF THE INVENTION

As specified in the Background Section above, there is a market opportunity for a cannabis based moist snuff that will appeal to cannabis users and offer an improved safety profile over tobacco based products.

Thus according to a first embodiment, the present invention provides a moist snuff composition comprising a cannabis component and a moist casing component. In particular, the cannabis component may be made primarily from the leaves and/or the stems of cannabis plants which are generally considered waste material in cannabis production. In some embodiments activated cannabinoids are added to the moist snuff. In some embodiments nicotine is added to the moist snuff.

Another embodiment is a method for producing a cannabis based moist snuff composition including the steps of cutting into pieces dried cannabis leaves and/or stems, mixing the cut up cannabis leaves and/or stems with a moist casing component.

DETAILED DESCRIPTION

These and other systems, methods, objects, features, and advantages of the present disclosure will be apparent to those skilled in the art from the following detailed description of the embodiments and drawings.

All documents mentioned herein are hereby incorporated in their entirety by reference. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from context.

Cannabis is a genus of flowering plant that includes three species (and seven taxa) or subspecies, sativa, indica, and ruderalis. The plant is indigenous to Central Asia and the Indian subcontinent. Cannabis has long been used for hemp fibre, for hemp oils, for medicinal purposes, and as a recreational drug. Industrial hemp products are made from cannabis plants selected to produce an abundance of fiber.

To satisfy the UN Narcotics Convention, some cannabis strains have been bred to produce minimal levels of tetrahydrocannabinol (THC), the principal psychoactive constituent. Many plants have been selectively bred to produce a maximum of THC (cannabinoids), which is obtained by curing the flowers.

The cannabinoids are a class of molecules primarily obtained through the extraction of cannabis plant material. The various cannabinoids include tetrahydrocannabinol (THC), cannabidiol (CBD), tetrahydrocannabinolic acid (THCA), Cannabidiolic acid (CBDA), cannabinol (CBN), cannabigerol (CBG), cannabichromene (CBC), tetrahydrocannabivarin (THCV), and cannabidivarin (CBDV) as well as others. Various cannabinoids, used alone or in combination have shown a variety of significant biological effects including but not limited to pain relief, anti cancer, anti inflammatory, anti emetic, anti convulsant, and many others.

During the production of cannabis plants for the production of cannabis products and extracts, the flowers or 'buds' of the cannabis plant are the primary component used. As a result, a substantial amount of fan leaves and stems are produced which are not used and are generally considered waste.

The present invention provides a cannabis based moist snuff composition and methods of producing such composition. In a preferred embodiment the herbal component of the cannabis based moist snuff composition is made primarily from the leaves of the cannabis plant. Other components of the moist snuff composition may include the stems of the cannabis plant. Other embodiments may include the bud material of the cannabis plant.

Generally the moist casing component is designed to deliver a pleasant flavor to the user. In some embodiments the flavor profile is designed to match the characteristic flavor profile associated with high quality cannabis. The moist casing component may include such ingredients as glycerin, propylene glycol, nicotine, caffeine, flavorants, cannabinoids, sweeteners, citric acid, ascorbic acid, and preservatives. While specific embodiments are discussed describing flavor profiles designed to deliver the distinct taste of high quality cannabis, other flavor profiles may also be implemented such as, for example, fruit flavors, mint flavors, tobacco flavors and the like.

Cannabis leaves, in particular the larger fan leaves which are generally considered waste in the cannabis industry are utilized as the primary herbal component of the cannabis based moist snuff. In a surprising discovery, the inventors found that these leaves when properly dried and cured may be used as the primary ingredient in a moist snuff composition. The cannabis leaves and stems used to make the invention have a particle size of about 3-60 mesh as measured using NBS screen sizes.

The cannabis leaves and stems are typically dried and cured before being particleized and mixed with the casing component. When dried the cannabis leaves and stems should have moisture content of about 7-10%. The drying and curing process removes the chlorophyll present in the plant leaves and results in a better tasting product. The curing step may be as simple as to allow the leaves to sit in a humidity controlled environment for 1-4 weeks. Alternatively, more complex curing steps may be taken.

In some embodiments additional ingredients may be added to the cannabis leaves and stems to improve the organoleptic qualities of the moist snuff. Additional ingredients may include, other herbal constituents, corn silk, alfalfa, coffee, chickory, coca leaves, tobacco, sweet clover, mint leaves, and the like. In some embodiments additional ingredients may be added to facilitate cannabinoid delivery, such as, for example ingredients adapted to improve cannabinoid and/or other pharmaceutical delivery across mucous membranes.

The casing component is combined with the cannabis leaf/stem component to create the cannabis based moist snuff. The casing material is used in varying amounts as a binder, a source of moisture, and a source of flavorants and/or other bioactive ingredients. The casing component may comprise ingredients that are liquid, semi-liquid, or solid. In the case of solid or powdered ingredients, they may be dissolved in the liquid ingredients prior to mixing with the cannabis leaf/stem component. Generally the ingredients of the casing component include molasses, glycerin, propylene glycol, vegetable glycerin, water, flavorants, sodium chloride, various buffers, sweeteners, and other bioactive ingredients.

Depending on the final characteristics desired of the cannabis based moist snuff composition, molasses may be added and will provide binding, moisturizing and flavoring to the composition. Molasses may be present in the casing component in an amount ranging from about 15-45% by weight of the casing component. Glycerin and propylene glycol, either alone or in combination are useful primarily as humectants and are also particularly suitable as carriers for other hydrophobic ingredients, such as for example, major and minor cannabinoids that may be additional ingredients in some embodiments of the composition. Glycerin and propylene glycol may be present in the composition at a range of about 8-25% by weight of the casing component. Additional water may be added to the composition to provide added moisture and/or as a carrier for hydrophilic ingredients in the composition. Water may be present in a range of about 8-25% by weight of the casing component.

In some embodiments caramel color may be added to the composition

Various flavoring compositions may be included in the casing component in a range of about 0.5%-10% by weight of the casing component. The role of the flavoring components are to confer an aroma and/or taste to the cannabis based moist snuff. Generally speaking, any flavorants known to those having skill in the art may be used, such as, for example, mint, clove, cherry, cinnamon and the like. Of particular value to the present invention are flavoring components designed to impart the distinct aroma of high quality cannabis flowers to the composition. The most relevant ingredients to achieve this end are the terpenes, terpenoids and other volatile compounds such as, for example, flavonoids, found in cannabis. The terpenes and terpinoids found in cannabis generally include over 120 compounds known to those having skill in the art, some of the more common include, but are not limited to: pinene, humulene, b-caryophyllene, isopulegol, guaiol, nerylacetate, neomenthylacetate, limonene, menthone, dihydrojasmone, terpinolene, menthol, phellandrene, terpinene, geranylacetate, ocimene, myrcene, 1,4-cineole, 3-carene, linalool, menthofuran, perillyalcohol, pinane, neomenthylaceta, and substantial others. These various terpenes may be added to the composition of the present invention in varying ratios. In some embodiments the ratios may be determined to mimic the ratios of terpenes/terpenoids found in popular cannabis strains. These ratios are known to those having skill in the art, and can be found, for example, at: https://shop.greenhouseseeds.nl/strains-terpenes-profiles.html.

In some embodiments, sodium chloride (NaCl) is added both to improve/enhance flavor, as a preservative and/or to induce salivation. A very fine grind of NaCl is used in the various formulations so that it completely dissolves in the casing component. NaCl is typically present in final formulations at about 2%-7% by weight of the casing component.

In some cases, sodium bicarbonate is added to the compositions to act as a buffer to neutralize acidity. In some embodiments this is used to reduce the acidity conferred by other components of the casing. In some cases, sodium bicarbonate is omitted, especially when the acidity of the formulation is a desired characteristic due to taste and or bioavailability. Sodium bicarbonate may be present in about 0.5-4% by weight of the casing.

Sweeteners, either nutritive or non nutritive may be present in some embodiments. Examples of non nutritive sweeteners include but are not limited to aspartame, saccharin, sucralose and the like. Nutritive sweeteners include but are not limited to sugar, corn syrup, cane syrup, molasses and the like. The amount of sweetener used will depend on the desired sweetness level of the final composition.

In some embodiments it may be desirable to provide a peppery sharpness or "bite." In order to accomplish this, a fine grind of cayenne or other capsaicin containing pepper may be included in the composition. Cayenne pepper may be present in the casing component as a dispersed solid in an amount ranging from about 0.01% to about 0.50% by weight of the casing component.

Certain preservatives known in the art as effective and safe for use in products held in the mouth may be included in the composition. Preferred preservatives for use in the present invention include, but are not limited to, parabens, such as methylparaben and propylparaben. When present, preservatives will be included in the casing component in an amount ranging from about 0.2% to about 0.7% by weight of the total composition.

Other ingredients may be incorporated into the casing component to enhance the organoleptic qualities and/or physiological effects of the cannabis based moist snuff composition.

Cannbinoid v. Non Cannabinoid Formulations

In some embodiments no additional cannabinoids are added to the cannabis based moist snuff composition. Because the leaves and stems of the cannabis plant contain very little cannabinoid content, the moist snuff formulations made from leaves and stems will have very little, if any cannabinoid content. Further, because the preparation steps used to make the cannabis based moist snuff compositions do not include substantial heating steps, any cannabinoids present in the leaves and stems would not be decarboxylated and will have reduced bioactivities. As a result, these formulations would not have intoxicating and/or other medicinal properties associated with typical cannabinoid administration. In some cases, this might be a desired characteristic, such as in cases where people want to enjoy the unique flavor profiles associated with cannabis without becoming intoxicated.

In some embodiments cannabinoids are added to the cannabis based moist snuff composition to provide recreational and/or medicinal effects. In such cases, cannabinoid extracts are added to the cannabis based moist snuff. For example, CO2, ethanol, or other solvent extracted cannabis oils are added so that the dosage of THC provided in a 400 mg wad of moist snuff is between 1-100 mg, and the dosage of CBD is between 1-100 mg. Generally the ratios of THC:CBD present in the cannabinoid fortified cannabis moist snuff compositions are between 1:100 and 100:1. The cannabinoids may be added as individual purified components and/or as whole plant, strain specific extracts. A particular benefit of the whole plant, strain specific extracts is the maintenance of the minor cannabinoid components. In some embodiments, the cannabinoids will be a nanoemulsion of cannabinoid components and/or whole plant cannabis extracts. Nano emulsions can be formed using any nano emulsion methods known to those having skill in the art.

In embodiments wherein the cannabis based moist snuff is made using the buds of the cannabis plant, cannabinoids will be present. In such embodiments, a decarboxylation step may be added to the process of making the moist snuff composition. For example, after grinding or other particlization step, the cut up cannabis material is placed in an oven and heated to 240 degrees F. for approximately 1 hour.

Exemplary Method for Making Cannabis Based Moist Snuff Compositions

After being removed from the stems, the leaves and stems of the cannabis plant are washed, optionally sanitized, dried and cut. In some embodiments only the leaves of the cannabis plant are used. In other embodiments, both the leaves and the stems of the plant are used in various proportions from about a 10:1 to a 1:1 ratio of leaves to stems. These steps may be performed in any order. Generally, the leaves are washed when they are first removed from the plant, then dried. In some cases, it may be desirable to age-cure the leaves to facilitate the removal of chlorophyll which may add an undesirable taste to the finished composition. Aging of the leaves can be accomplished by placing the leaves in a sealed container and allowing the leaves to sit in a controlled environment for 2-4 weeks, opening and closing the container at least once each day. The leaves may be smoke cured, or cured by other means known to those having skill in the art. When cut, the particle size of the leaves and stems is about 3 mesh to about 60 mesh. This invention contemplates that any particle size may be used, but particles less than about 40 mesh may be too small to form a coherent mass in the mouth, while uncut leaves and stems larger than about 4 mesh may be too large to be easily packable in the mouth.

All the liquid or semi-liquid ingredients are mixed together for about 20 to about 40 minutes to produce the liquid portion of the casing component. In an exemplary embodiment, the liquid ingredients are: the flavoring compositions, glycerin/propylene glycol/preservatives, molasses, water, activated cannabinoids and optionally nicotine. To aid in thoroughly mixing the liquid portion, one or more of the liquids may be warmed to a temperature between about 100 degree F. to about 120 degree F. prior to mixing.

The dry ingredients of the casing component are mixed with the herbal component, the dry ingredients, or a portion of the casing component. In an exemplary embodiment this includes artificial sweetener, cayenne powder, sodium bicarbonate, and sodium chloride. The dry portion of the casing component is preferably mixed with the herbal component for at least about 2 minutes in a blender, i.e., a ribbon-type blender, by hand, or by other suitable mixing device known to those having skill in the art.

After the dry ingredients of the casing component are well mixed with the herbal component, the liquid portion of the casing component is dispensed into the ribbon blender or other suitable mixing vessel. Once the liquid portion of the casing component is fully dispensed, the resulting composition is blended/mixed for approximately five minutes.

The resulting moist snuff composition is sealed for a storage/tempering/curing time of about 6 hours to about 12 hours before beginning the packing process. During this time, the casing component more fully blends with the herbal component resulting in a proper consistency for packaging. The resulting cannabis based moist snuff composition may be packaged in any suitable container, such as in a tin, in a plurality of individual mesh pouches, such as for example those employed by Skoal® in their "bandits" product, snus, or Copenhagen® pouches, or any other package known in the art.

While the present disclosure includes many embodiments shown and described in detail, various modifications and improvements thereon will become readily apparent to those skilled in the art. Accordingly, the spirit and scope of the present invention is not to be limited by the foregoing examples, but is to be understood in the broadest sense allowable by law.

With respect to the above, it is to be understood that the invention is not limited in its application to the details of construction and to the arrangement of the components listed or the steps set forth in the description or illustrated in the drawings. The various apparatus and methods of the disclosed invention are capable of other embodiments, and of being practiced and carried out in various ways that would be readily known to those skilled in the art, given the present disclosure. Further, the terms and phrases used herein are for descriptive purposes and should not be construed as in any way limiting.

As such, those skilled in the art will appreciate that the conception upon which this disclosure is based may be utilized as a basis for designing other inventions with similar properties. It is important therefore that the embodiments, objects, and claims herein, be regarded as including such equivalent construction and methodology insofar as they do not depart from the spirit and scope of the present invention.

What is claimed is:

1. A moist snuff composition comprising:

a nonintoxicating herbal component primarily comprising the fan leaves of the cannabis plant with substantially no THC, with the fan leaves being the primary herbal component of the snuff composition by weight, and with the fan leaves having been dried and cured to remove chlorophyll therefrom; and a casing component absorbed by and surrounding the herbal component, said casing component including molasses in an amount ranging from about 15-45% by weight of the casing, glycerin and propylene glycol, either alone or in combination, in an amount ranging from about 8-25% by weight of the casing, and water in an amount of about 8-25% by weight of the casing.

2. The moist snuff composition of claim 1 further comprising: cannabis stems.

3. The moist snuff of claim 2, wherein the leaves:stems ratio is within a range of about 10:1-1:1.

4. The moist snuff of claim 2, wherein the leaves and stems have a particle size of about 3-60 mesh.

5. The moist snuff of claim 2, wherein the cannabis stems have been dried to a moisture content of 7-10%.

6. The moist snuff composition of claim 1 further comprising: decarboxylated cannabinoid extracts.

7. The moist snuff composition of claim 6 wherein the decarboxylated cannabinoid extracts have a ratio of THC: CBD between 1:100 and 100:1.

8. The moist snuff composition of claim 7 wherein the decarboxylated cannabinoid extracts are whole plant, strain specific extracts.

9. The moist snuff composition of claim 6 wherein the decarboxylated cannabinoid extracts are in a nanoemulsion.

10. The moist snuff composition of claim 1, wherein the casing component further comprises a liquid nicotine component and wherein the liquid nicotine component is present in an amount ranging from about 0.005 to 0.2% by weight of the moist snuff composition.

11. The moist snuff composition of claim 1, wherein the casing component further comprises a flavoring component comprising at least one terpene, terpenoid, or combination thereof.

12. The moist snuff of claim 11, wherein the flavoring component comprises a plurality of terpenes, terpenoids, or a combination thereof.

13. The moist snuff composition of claim 1, with the casing component further including a capsaicin-containing pepper compound to provide a pepper taste to the moist snuff.

14. The moist snuff of claim 13, wherein the capsaicin-containing pepper compound is cayenne pepper, optionally wherein the cayenne pepper is present in the casing component as a dispersed solid in an amount ranging from about 0.01% to about 0.50% by weight of the casing component.

15. The moist snuff of claim 1 further comprising NaCl in an amount ranging from 2-7% by weight of the casing and sodium bicarbonate in an amount ranging from about 0.5-4% by weight of the casing.

16. The moist snuff of claim 1, further comprising cannabis buds.

17. The moist snuff of claim 1, wherein the casing component further comprises a preservative, optionally a paraben.

18. The moist snuff of claim 17, wherein the preservative is present in an amount ranging from about 0.2% to about 0.7% by weight of the total composition.

19. The moist snuff of claim 1, further comprising a solvent extracted cannabis oil, optionally wherein the oil is present in an amount sufficient to provide 1-100 mg/400 mg moist snuff of at least one of THC and CBD.

20. A moist snuff composition comprising:

a nonintoxicating herbal component primarily comprising the fan leaves of the cannabis plant with substantially no flowers or buds of the cannabis plant, with the fan leaves being the primary herbal component of the snuff composition by weight, and with the fan leaves having been dried and cured to remove chlorophyll therefrom;

a casing component absorbed by and surrounding the herbal component; and decarboxylated cannabinoid extracts, wherein the decarboxylated cannabinoid extracts are in a nanoemulsion.

* * * * *